US005738500A

United States Patent [19]

Sundberg et al.

[11] Patent Number: 5,738,500

[45] Date of Patent: Apr. 14, 1998

[54] VARIABLE DISPLACEMENT VANE PUMP HAVING LOW ACTUATION FRICTION CAM SEAL

[75] Inventors: Jack G. Sundberg, Meriden; Raymond D. Zagranski, Somers, both of Conn.; Martin Thomas Books, Columbus, Ind.

[73] Assignee: Coltec Industries, Inc., New York, N.Y.

[21] Appl. No.: 544,374

[22] Filed: Oct. 17, 1995

[51] Int. Cl.[6] ..... F04B 23/10; F04C 2/344; F04C 15/04

[52] U.S. Cl. ..... 417/204; 417/220; 418/30; 418/133

[58] Field of Search ..... 417/204, 220; 418/24–27, 30, 31, 133

[56] References Cited

U.S. PATENT DOCUMENTS 3,523,746 8/1970 Dadian et al. ..... 418/26
4,551,079 11/1985 Kain ..... 418/31
5,178,525 1/1993 Murota ..... 418/30
5,484,271 1/1996 Stich ..... 418/30

*Primary Examiner*—John J. Vrablik
*Attorney, Agent, or Firm*—Howard S. Reiter, Esq.

[57] ABSTRACT

A variable displacement vane pump comprising a durable rotor member having journal ends at each side of a larger diameter central vane section comprising vane slots having well areas which slidably-engage a mating vane element. The present vane pump comprises an outer cylindrical cam enclosure or spacer loaded against ring seal elements to support the faces of the seal elements closely spaced from the cam faces and reduce the actuation force required for adjustment of the displacement capacity of the pump. The cam faces include a biased segment seal in the high pressure discharge arc area. The seal elements include first fuel inlet passages in the inlet arc segment thereof, and fuel discharge passages in the discharge arc segment thereof, both of said passages being open to the vane slot extensions and to the cam chamber for the continuous supply and pressure discharge of fuel.

7 Claims, 2 Drawing Sheets

VARIABLE DISPLACEMENT VANE PUMP HAVING LOW ACTUATION FRICTION CAM SEAL

BACKGROUND OF THE INVENTION

1. Field of the Invention

The present invention relates to single acting, variable displacement fluid pressure vane pumps such as for aircraft use.

Over the years, the standard of the commercial aviation gas turbine industry for main engine fuel pumps has been a single element, pressure-loaded, involute gear stage charged with a centrifugal boost stage. Such gear pumps are simple and extremely durable, although heavy and inefficient. However, such gear pumps are fixed displacement pumps which deliver uniform amounts of fluid, such as fuel, under all operating conditions. Certain operating conditions require different volumes of liquid, and it is desirable and/or necessary to vary the liquid supply, by means such as bypass systems which can cause overheating of the fuel or hydraulic fluid and which require heat transfer cooling components that add to the cost and the weight of the system.

2. State of the Art

Vane pumps and systems have been developed in order to overcome some of the deficiencies of gear pumps, and reference is made to the following U.S. Pat. Nos. for their disclosures of several such pumps and systems: 4,247,263; 4,354,809; 4,529,361 and 4,711,619. Reference is also made to co-pending commonly-owned U.S. application Ser. No. 08/114,253, filed Aug. 30, 1993, the disclosure of which is hereby incorporated herein.

Vane pumps comprise a rotor element machined with slots supporting radially-movable vane elements, rotatable within a cam member between opposed bearings, and having fluid inlet and outlet ports through which the fluid is fed to the low pressure inlet areas or vane buckets of the rotor surface for rotation, compression and discharge from the high pressure outlet areas or vane buckets of the rotor surface as pressurized fluid.

Vane pumps that are required to operate at high speeds and pressures preferably employ hydrostatically (pressure balanced) vanes for minimizing frictional wear. Such pumps may also include rounded vane tips to reduce vane-to-cam surface stresses. Examples of vane pumps having pressure-balanced vanes which are also adapted to provide undervane pumping, may be found in the aforementioned co-pending application and in U.S. Pat. Nos. 3,711,227 and 4,354,809. The latter patent discloses a vane pump incorporating undervane pumping wherein the vanes are hydraulically balanced in not only the inlet and discharge areas but also in the seal arcs whereby the resultant pressure forces on a vane cannot displace it from engagement with a seal arc.

Variable displacement vane pumps contain a swing cam element which is adjustable or pivotable, relative to the rotor element, in order to change the relative volumes of the inlet and outlet or discharge buckets and thereby vary the displacement capacity of the pump.

In conventional single acting vane pumps the rotor is splined upon and driven by a central drive shaft having small diameter journal ends/ which are not strong enough to withstand the opposed inlet and outlet hydraulic pressure forces generated during normal operation. This problem is overcome by forming such pumps as double-acting pumps having opposed inlet arcs and opposed outlet or discharge arcs which balance the forces exerted upon the journal ends, as disclosed by the prior art such as U.S. Pat. Nos. 4,354,809 and 4,529,361, for example.

Among the disadvantages of the latter known vane pumps is the necessity of two inlet arcs and two discharge arcs as compared to single acting pumps which have a single inlet arc and a single outlet arc. The shorter inlet arcs of dual-acting pumps requires that the vanes be pressure-loaded in the area of the inlet arc in order to cause the vane tip to track or maintain continuous contact with the cam surface. This results in higher vane-to-cam stresses and eliminates use of undervane pumping. The dual pump arcs also introduce additional leakage areas.

Variable displacement single acting vane pumps also have leakage problems in the high pressure discharge arc, which require cam seal elements which frictionally-engage the cam faces in the discharge arc area while also sealing the journal ends of the rotor to prevent axial leakage along the journal ends. The efficiency of the cam seal is proportional to the degree of frictional engagement whereas the ease of adjustability of the displacement capacity of the pump is inversely proportional to the degree of frictional engagement between the cam seals and the cam faces. High frictional engagement improves the seal properties but increases the activation forces necessary to adjust the displacement properties of the pump. It would be advantageous to design a VDVP in which the degree of frictional engagement between the cam surfaces and the seal elements in the discharge arc area is relatively low, for ease of adjustability, while the cam seals are maintained in tight sealing engagement with the journal ends of the rotor and with the pump housing.

SUMMARY OF THE INVENTION

The present invention relates to novel single acting, variable displacement vane pumps, which have the durability, ruggedness and simplicity of conventional gear pumps, and the versatility and variable metering properties of vane pumps. The present pumps incorporate novel pressure balanced segment seals in the cam faces to provide more effective cam seal leakage resistance at low frictional forces, to more effectively confine the high pressure within the cam member, and prevent axial pressure leakage along the length of the rotor member while providing ease of cam adjustment at low activation forces.

The novel pumps of the present invention comprise a durable rotor member, preferably one which is machined from barstock, in manner and appearance similar to the main pumping gear of a gear pump, so as to have large diameter journal ends at each side of a larger diameter central vane section comprising a plurality of axially-elongated radial vane slots, the well area of each vane slot slidably-engaging a mating vane element. An adjustable narrow cam member having a continuous circular inner cam surface surrounds and encloses the central vane section to form the cam chamber, and the cam surface is engaged by the outer surfaces or tips of the vane elements during operation of the pump. The journal ends of the rotor member are rotatably-supported within opposed durable bearings, which are fixed to the housing, and have faces which confine the present cylindrical cam seals between themselves and the opposed faces of a cylindrical cam enclosure which is slightly wider than the cam member and closely-spaces the cam faces from the faces of the seal elements. During rotation of the journals of the vaned rotor member within the bearings and of the raised central vane section of the rotor member within the cam member, fluid such as liquid fuel is admitted at low pressure to the inlet arc segment of the cam chamber, via inlet passages through each of the cam seals, and into expanding inlet bucket chambers between the vanes, and also through the vane slot extensions to under-vane slot areas. Continued rotation of the rotor member through a sealing arc segment into a discharge arc segment reduces the volume of the bucket areas and changes the pressure acting upon the leading face of each vane changes from low inlet pressure to discharge pressure. The pressurized fuel escapes through discharge passages in each seal element, and is channelled to its desired destination.

The faces of the cam member, in the area of the pressure discharge arc of the pump, are provided with semi-circular segment seals which are biased outwardly from cam recesses to extend beyond the cam faces and engage the faces of the seal elements with a sealing force which is independent of the degree of frictional engagement between the outer cam enclosure and the faces of the seal elements, for ease of adjustability while retaining good sealing properties.

The novel vane pumps of the present invention also provide substantial undervane pumping of the fluid from the undervane slot areas by piston action as the vanes are depressed into the slots at the discharge side of the cam chamber. Such undervane pumping can contribute up to 40% or more of the total fluid displacement.

The essential novelty of the vane pumps of the present invention resides in the novel cam spacer or enclosure, the biased cam segment seals and the cylindrical cam seal elements, each of which seal elements has an outer annular contact face portion which tightly engages a face of the outer cam spacer or enclosure, and a radially-inward cam sealing face which engages a biased segment seal recessed within each cam face and continuously seals a face side of the cam member, in the high pressure discharge arc segment thereof. Each cam seal element also has an inner annular flange portion which sealingly-engages the bearing member against which it is mounted, to seal axial leakage to the journals.

The present cam seal elements are integral annular bushing elements which are sealingly engaged within the pump housing between a bearing member and a face of the cam enclosure, and which are provided with fluid inlet passages in the inlet arc area of the cam chamber and with fluid discharge or outlet passages in the discharge arc area of the cam chamber. The cam seal elements are pressure-loaded against the cam enclosure or spacer while the segment seals are biased against and sealingly engage the cam faces. The inner flanges of the seal elements provide a 360° seal with the rotor and with the bearing to seal the fluid discharge passage in the high pressure pumping arc from axial leakage along the rotor journals.

DETAILED DESCRIPTION

Figure 1:
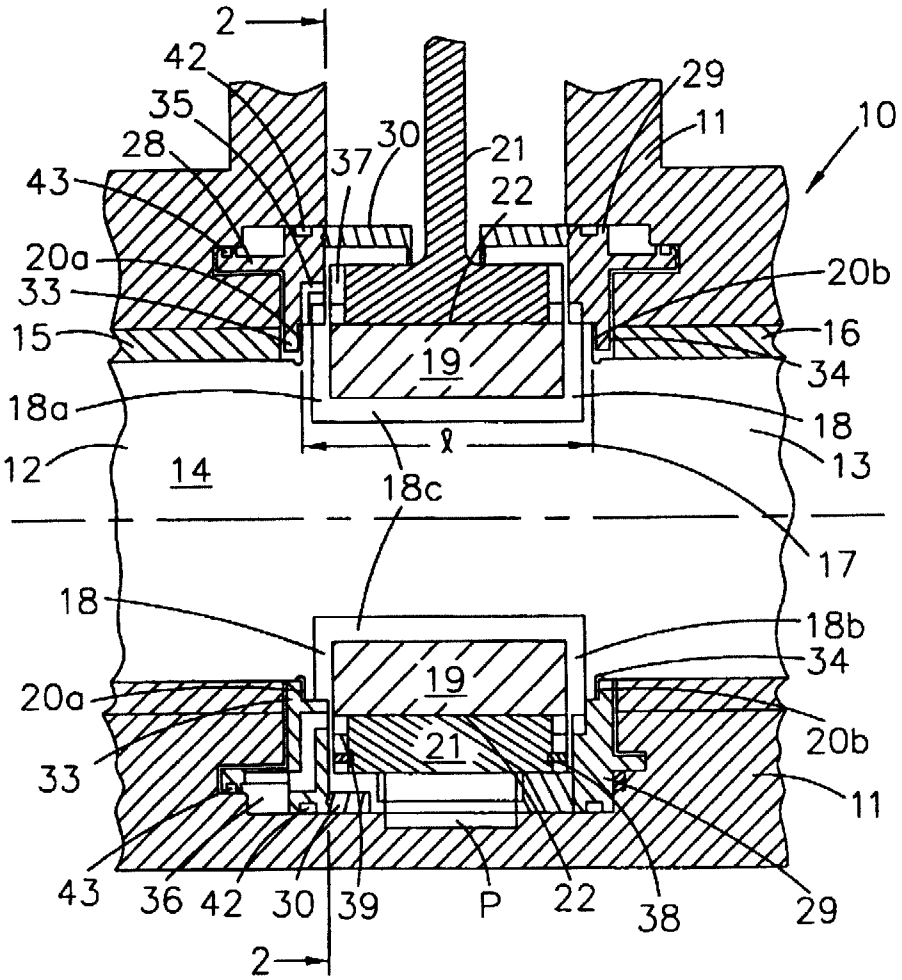
FIG. 1 is a vertical cross-sectional view of a fuel pump assembly according to one embodiment of the present invention.

FIG. 1 illustrates a fuel pump assembly 10 sealingly engaged within a housing 11 for free rotation of the journal ends 12 and 13 of the rotor member 14 within bearings 15 and 16 which are interference fit within the housing 11. The rotor member 14 comprises a cylindrical central vane-supporting section 17 of increased diameter, relative to the journal ends 12 and 13, and having a length "1", as shown. Rotor section 17 comprises a plurality of radially-extending vane slots 18, generally ten in number, each of which supports a vane element 19 for radial movement therewithin and each of which is longer than the vane element 19 to provide slot extensions **18*a* and 18*b* adjacent each end of the vane element, which extensions communicate with undervane slot areas 18*c*. The vane slots 18 are shorter in length than the length "1" of the rotor section 17 to leave continuous 360° marginal bearing areas 20*a* and 20*b* around the opposed edges of the rotor section 17**.

The pump assembly 10 comprises an annular cam member 21 having a smooth continuous inner cam surface 22 which is spaced from the surface of the rotor section 17 to provide an eccentric annular cam chamber 23 which is variable by pivoting the cam member 21 on pivot pin P to adjust the concentricity of the cam member 21 relative to the rotor member 14 to vary the displacement of the pump.

The cam chamber 23 is divided into cam bucket areas which are the areas between the faces of adjacent vane elements 19 carried by the rotor section 17. As is conventional with variable displacement vane pumps, the volume or capacity of the vane bucket areas increases in the low pressure fluid inlet arc 24 of the pump, shown in FIG. 2, to fill with the liquid, such as fuel, and decreases through the high pressure fluid discharge arc 26 of the pump to displace the fluid. Seal arcs 25 and 27 are provided between the low and high pressure areas 24 and 27 to isolate and seal them from each other and provide for normal cyclical pumping operation.

The final essential elements of the present fuel pump assemblies 10 are the cylindrical outer cam spacer or enclosure 30, and the unitary cam seal elements 28 and 29 which are annular ring seal members which tightly engage the cam spacer or enclosure 30 and the housing 11 within which the seal elements are mounted to support the faces of the slightly-narrower cam element 21 closely spaced from the faces of the cam seal elements 28 and 29. In the area of the seal arcs 25 and 27 and the high pressure discharge arc 26 of the pump, the faces of the cam element 21 are provided with a semicircular recess or arcuate slot 37 containing an outwardly-biased semicircular or arcuate segment seal 38 which makes sealing engagement with the face of a cam seal element to seal the cam chamber in the areas of the seal arcs 25 and 27 and the high pressure discharge arc 26, to prevent radial leakage. The cam seal elements 28 and 29 also have an inner circular radial flange or lip 33 or 34 which extends between the inner edge of a bearing 15 or 16 and an outer edge of the rotor section 14 to seal against axial leakage along the rotor journals 12 and 13. Finally, the cam seal elements 28 and 29 also contain isolated fuel inlet passages 35 which communicate with the vane slots in the fuel inlet arc 24 areas of the cam chamber across arcuate slot 37 on the cam face to admit fuel to the low pressure inlet buckets of the cam chamber and and fuel outlet or discharge passages 36 which communicate with the vane slots **18*b* in the fuel discharge arc 26 areas of the cam chamber to permit the escape of the high pressure fuel from the discharge buckets of the cam chamber through the arcuate cam recess 39 to the fuel discharge passages 36**.

The single piece cam seal elements 28 and 29 of the present invention are less complex and more durable than prior known multi-component cam seal elements used on variable displacement vane pumps of different types to serve the same purposes, i.e., to seal the cam faces in the seal arc areas 25 and 27 of the cam chamber and to admit fuel or other liquid in the low pressure inlet arc 24 and to channel the fuel or other liquid from the high pressure discharge arc 26 to an outlet conduit while sealing the pump against axial leakage along the journal ends 12 and 13 of the rotor member 14. However such sealing is accomplished without the usual tight frictional engagement between the seals 28 and 29 and the cam member 21 of conventional pumps, which tight engagement requires the use of large actuation forces to produce relative slippage between faces of the cam seals and the cam faces during adjustment of the displacement capacity of the pump. The reduced but effective sealing engagement is enabled by the use of the cylindrical cam spacer or enclosure 30 which is slightly wider than the cam member 21 and which tightly engages the surfaces of the cam seal elements 28 and 29, which tight engagement is not disturbed during adjustment of the displacement capacity of the pump.

Figure 2:
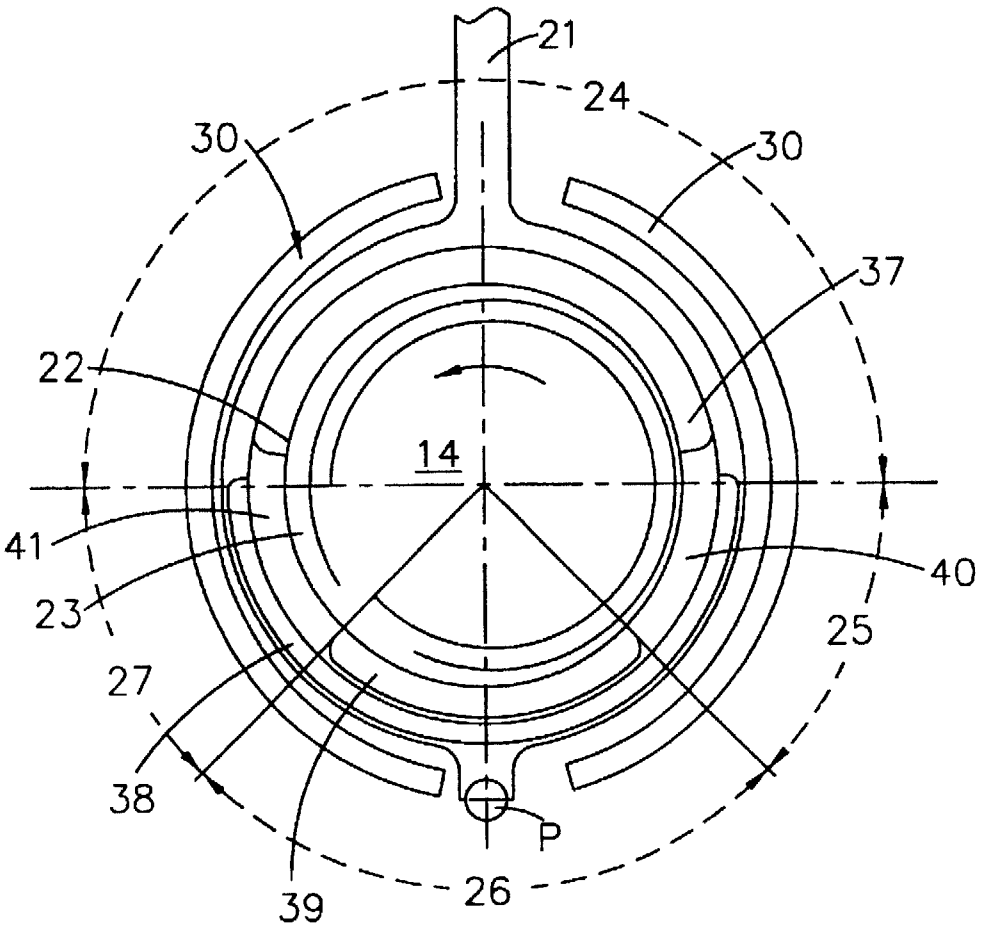
FIG. 2 is a view of the cam enclosure or spacer and the cam element of Fig. 1 taken along the line 2—2.

The present cam seal elements 28 and 29 are identical to each other and are supported closely spaced from the opposed cam faces to provide a 360° outer peripheral seal except in the area of the fuel inlet grooves or passages 37 in the cam surface in the fuel inlet arc 24 of the pump, shown in FIGS. 1 and 2, which admit fuel into the cam seal inlet passage 35 of the seal elements 28 and 29 and to the undervane slot areas **18*c* of each vane slot 18 as the rotor 14 rotates through the inlet arc 24. This fills each of the vane buckets before it is rotated into the inlet seal arc 23, where it becomes sealed by the arcuate segment seal 38 in each cam face, while each vane bucket contracts to displace the fuel therefrom. Rotation of the rotor member into the discharge arc 26 opens the vane buckets to the cam seal outlet passage 36, through the vane slot extensions 18*a* and 18*b* and the cam recess 39, to channel the pressurized fuel from the vane buckets and from the undervane slot areas 18*c* through the cam seal outlet passage 36** and through housing discharge conduits to the desired destination, such as a fuel-powered engine.

As the rotor member rotates from the discharge arc 26 through the inlet seal arc 25, the vane buckets become sealed by the cam face 40 and the seal element 28 or 29 before entry into the low pressure inlet arc 24 of the cam chamber and communication with the fuel inlet passage 35 of the cam seal elements 28 and 29. A continuous supply of liquid fuel is fed into the vane buckets through the fuel inlet grooves or passages 37 present in the cam faces in the fuel inlet arc 24, and through the cam seal inlet passages 35 in the fuel inlet arc 24, to fill the vane slot extensions **18*a* and 18*b*, the undervane areas 18*c*, and the expanded vane buckets before they are sealed by the cam face 41 in the seal arc area 27** to repeat the pumping cycle.

Each seal element 28 and 29 is sealed to the housing 11, adjacent the area of its pressure engagement with the cam spacer 30, by means of an outer peripheral gasket or o-ring 42, to prevent axial fuel leakage in both the inlet arc 24 and the discharge arc 26. Also, each seal element 28 and 29 is sealed to the housing 11 by means of a second peripheral gasket or o-ring 43, to prevent axial fuel leakage along the journals 12 and 13 of the rotor member 14.

As shown in FIG. 1, the seal elements 28 and 29 have an inner circumferential surface comprising a circular flange portion or lip 33 or 34 which extends between the rotor bearings 15 or 16 and the opposed smooth flat radial faces of the central vane-supporting section 17, and a wall extension which overlaps the marginal bearing areas **20*a* and 20*b*, leaving small clearance therebetween, such as from 0.0002" to about 0.0005" loose. This clearance provides the area for a seal land to further seal leakage to the rotor journals 12 and 13 of the rotor member 14, adjacent the 360° bearing areas 20*a* and 20*b* which function as a seal between the pumping arc 26 and the rotor journals 12 and 13**. The end result is a simplified VDVP having excellent efficiency and minimized fuel leakage which is confined internally to provide lubrication during pump operation.

Figure 3:
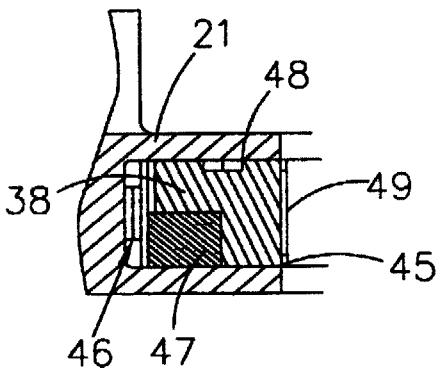
FIG. 3 is an enlarged cross-sectional view of the segment seal assembly within the cam element of FIG. 1.

The critical segment seal 38 which provides effective sealing between the faces of the cam member 21 and the cam seal elements 28 and 29 while facilitating adjustment of the displacement capacity under low actuation forces is illustrated most clearly by FIG. 3 according to one effective embodiment thereof. Each face of the cam member 21 is provided with a semicircular slot or arcuate recess 45 in the area of the high pressure discharge arc 26 of the cam chamber. Each recess 45 receives an arcuate segment seal 38 which is biased outwardly from the recess for sealing engagement with a face of a cam seal element 28 or 29. In the embodiment of FIG. 3, the segment seal is outwardly biased by means of a spring washer 46 loaded against the floor of the recess, and includes a gasket 47 for improved sealing, and surface machine cuts 48 and 49 to reduce the surface area of frictional engagement and the seal load on the outer diameter and on the seal face to reduce the resulting frictional force for ease of cam actuation.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A durable, vane pump comprising:

(a) a rotor member having journal ends and a cylindrical central vane section comprising a plurality of radial vane slots uniformly spaced around the central circumference thereof, said vane slots being elongate in the axial direction and having a central vane-supporting portion with axial vane slot extensions at each end thereof, extending beyond said central vane section;

(b) a plurality of vane elements, each slidably-engaged within the central vane-supporting portion of a said slot for radial movement therewithin, leaving said vane slot extensions at each end thereof;

(c) an adjustable unitary cam member having a uniform width and opposed faces and a bore therethrough forming a cam chamber having a continuous interior cam surface, the central vane-supporting portion of the cylindrical vane section of said rotor member being supported within said cam chamber so that the outer tip surfaces of all of the vane elements make contact with said continuous interior cam surface during rotation of said rotor member between a low pressure inlet arc segment, a high pressure outlet arc segment and intermediate seal arc segments of said cam chamber; the opposed faces of said cam member having at least one liquid inlet groove in the low pressure inlet arc segment thereof, and arcuate slots in corresponding areas of the high pressure outlet arc segments thereof, each said slot containing an elongate arcuate sealing member which is biased outwardly from its slot, said vane slot extensions of the rotor member extending axially beyond said cam chamber;

(d) an outer cylindrical cam enclosure or spacer having a larger diameter than the cam member and having a width which is slightly greater than the width of the cam member;

(e) an opposed pair of bearings rotatably supporting the journal ends of said rotor member; and (f) an opposed pair of cylindrical cam seal elements, one each between a said bearing and a face of said cam member, each said seal element having an outer radial face surface which tightly engages an edge of said cam enclosure or spacer to support an inner radial face surface of each cam seal element closely spaced from a face of said cam member except in the area of the high pressure outlet arc segments of each seal element, where the radial face surfaces of each cam seal element make sealing engagement with said arcuate sealing members on the opposed faces of the cam member, each cam seal element having an inner circumferential surface which overlaps the vane slot extensions of the central vane section of the rotor member; each said seal element further including liquid-conveying passages which open to the vane slot extensions and communicate with the cam chamber, the first said passage being located in the inlet arc segment of each seal element and being open to at least one said liquid-inlet groove in the surface of the cam faces, and the second said passage being located in the discharge arc segment of each seal element and being open to a liquid discharge conduit, to permit the continuous supply and pressure discharge of a liquid through said pump while minimizing leakage thereof, whereby the adjacent faces of the cam seal elements and of the cam member are fixed in closely-spaced, friction-free relation, except in the areas of engagement between said arcuate sealing members and said opposed faces of the cam member, to provide a low actuation force, variable displacement pump.

2. A vane pump according to claim 1 in which the central vane section of the rotor member has a greater radius than the journal ends and a length greater than said vane slots, to provide marginal bearing areas around the opposed edges of the rotor vane section for sealing engagement with said cam seal elements.

3. A vane pump according to claim 2 in which each said cam seal element has an inner circumferential surface comprising an annular flange portion which extends between one of said bearings and the surface of a journal end of the rotor member.

4. A vane pump according to claim 3 in which each said cam seal element has an inner circumferential surface which extends from its flange portion and overlaps a marginal bearing area of the central vane section of the rotor member for greater sealing against axial leakage.

5. A vane pump according to claim 1 in which the arcuate sealing members within the opposed faces of the cam member are biased outwardly by means of a spring member between the sealing member an the floor of the arcuate slot.

6. A vane pump according to claim 1 in which each arcuate sealing member has a face surface which is cut to reduce the surface area to produce a predetermined reduced degree of frictional engagement with the face of the cam seal element which it engages.

7. A pump according to claim 1 comprising a support housing sealingly engaged by an outer peripheral gasket on each said cam seal element, adjacent the area at which the radial face of the seal element tightly engages the cam spacer, and by an inner peripheral gasket which sealingly engages a portion of a support housing adjacent a bearing, to seal the pump against axial liquid leakage.

* * * * *